US006833537B2

(12) United States Patent
Risman et al.

(10) Patent No.: US 6,833,537 B2
(45) Date of Patent: Dec. 21, 2004

(54) MICROWAVE SYSTEM FOR HEATING VOLUMINOUS ELONGATED LOADS

(75) Inventors: Per Olov G. Risman, Harryda (SE); Pia Larsson Brelid, Gothenburg (SE); Rune Simonson, Sävedalen (SE)

(73) Assignee: A-Cell Acetyl Cellulosics AB, Savedalen (SE)

( * ) Notice: Subject to any disclaimer, the term of this patent is extended or adjusted under 35 U.S.C. 154(b) by 39 days.

(21) Appl. No.: 10/310,921

(22) Filed: Dec. 6, 2002

(65) Prior Publication Data

US 2003/0205574 A1 Nov. 6, 2003

(30) Foreign Application Priority Data

Dec. 17, 2001 (SE) ..... 0104260

(51) Int. Cl.[7] ..... H05B 6/70
(52) U.S. Cl. ..... 219/690; 219/693
(58) Field of Search ..... 219/690, 696, 219/745, 750, 680, 691, 693, 695, 697, 698, 699, 670, 388, 752

(56) References Cited

U.S. PATENT DOCUMENTS 3,461,261 A * 8/1969 Lewis et al. ..... 219/693
6,020,579 A * 2/2000 Lewis et al. ..... 219/696
6,297,479 B1 * 10/2001 Wefers ..... 219/388

* cited by examiner

*Primary Examiner*—Quang T. Van
(74) *Attorney, Agent, or Firm*—Harness, Dickey & Pierce, P.L.C.

(57) ABSTRACT

A Microwave heating system includes an elongated cylindrical metal cavity intended for heating a voluminous elongated load. The system includes microwave feeding means arranged to generate a single mode of the circular type $TE_{m;n;p}$ (a so-called whispering gallery mode) inside the cavity in order to heat the elongated load, wherein the circumferential index m is at least 4, the radial index n=1 and the axial index p being >0. The heating system is preferably adapted for wood processing.

30 Claims, 2 Drawing Sheets

MICROWAVE SYSTEM FOR HEATING VOLUMINOUS ELONGATED LOADS

CROSS-REFERENCE TO RELATED APPLICATIONS

This nonprovisional patent application claims priority upon Swedish Patent Application No. 0104260-5, filed on Dec. 17, 2001, the entire contents of which are herein incorporated by reference.

FIELD OF THE INVENTION

The present invention relates to a microwave heating system for heating voluminous elongated loads and a method in the system according to the preambles of the independent claims.

BACKGROUND OF THE INVENTION

The primary area of the invention is large microwave applicators for treatment of large loads with typically lower permittivities than those of compact items with high water content. In particular, the invention relates to tank systems with over- or underpressure in which the load is located. Such systems will typically consist of thick wall pressure tanks with circular cross section and provisions for load insertion and removal through solid heavy doors at one or both ends.

However, the person skilled in the art of microwave heating appreciates that the invention is equally applicable for treatment of smaller loads using an appropriately sized microwave cavity volume.

A microwave heating system is known, from e.g. U.S. Pat. No. 4,045,639 that discloses a system used mainly for microwave drying of delicate food substances with underpressure in a tank. However, no particular provisions for creating particular or desirable mode patterns are addressed—multimode cavity characteristics are used, and the microwave feeding is performed through microwave transparent windows using known rectangular $TE_{1;0}$ waveguides or even larger windows.

A particular problem with pressurised microwave applicators concerns the need for a seal of the microwave feed-through device that does not leak air/gas or liquid. In particular, common types of waveguide windows with conventional seals cannot be used when corrosive media exist and participate in the chemical processing in the tank, and when there is a significant difference between its pressure and that of the ambient. The problems are exacerbated with high temperatures and temperature cycling.

Using coaxial line feed-through provisions will reduce the problems with sealing of the periphery as well as allow smaller cross section dimensions so that the mechanical strength of the tank is improved, in comparison with the use of state-of-the art microwave windows. However, the electric field intensity is highest at the centre conductor, which together with the normally unavoidable resistive losses in this conductor may result in a quite low power handling capability.

The object of the present invention is to achieve a microwave heating system where the heating pattern inside a cavity is easier to control and predict. Still another object is to achieve a microwave heating system especially adapted for treatment of voluminous elongated loads.

SUMMARY OF THE INVENTION

The above-mentioned objects are achieved by the present invention according to the independent claims.

Preferred embodiments are set forth in the dependent claims.

Thus, the present invention relates to a microwave heating system especially adapted for heating voluminous elongated loads arranged in a cavity where a heating pattern persists, caused by a cavity single mode.

SHORT DESCRIPTION OF THE APPENDED DRAWINGS

DETAILED DESCRIPTION OF PREFERRED EMBODIMENTS OF THE INVENTION

Figure 1:
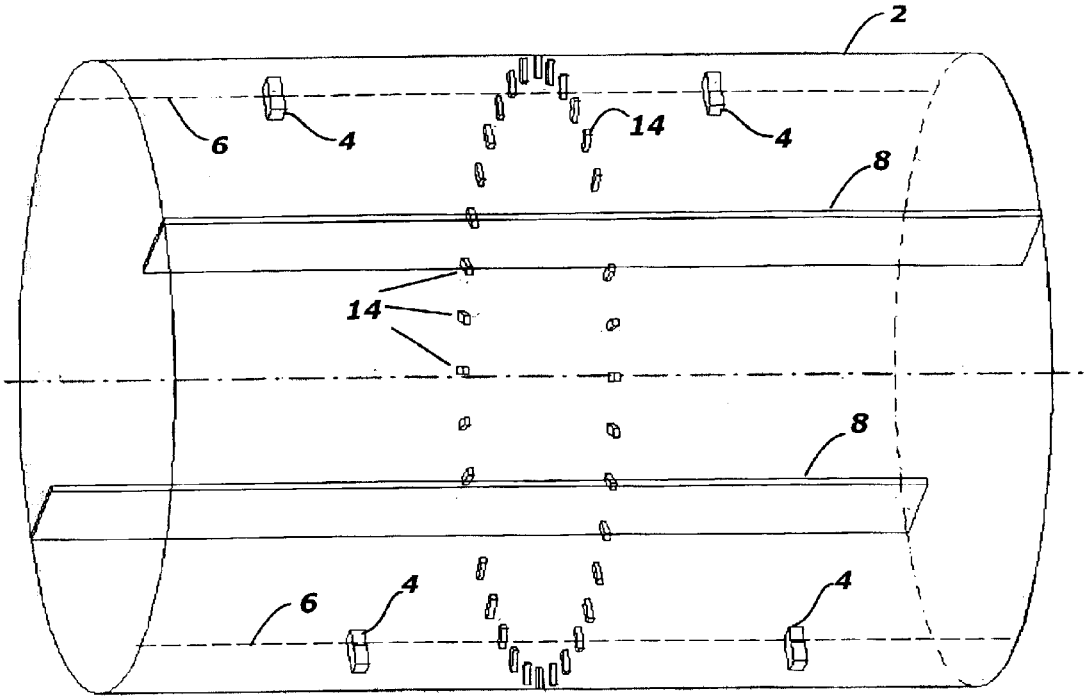
FIG. 1 shows a simplified illustration in a perspective view of a microwave heating system according to a preferred embodiment of the present invention, without a load.

In order to increase the understanding of the present invention using the particular $TE_{m;n;p}$ modes, also referred to as whispering gallery modes in the present invention, these modes will be further described in the following.

In the designation of circular $TE_{m;n;p}$, modes, all indices are integers with n, p>=1. The m index is the number of circumferential wavelengths of the standing wave mode pattern at the periphery, the n index is related to the number of field zeroes in the radial direction, and the p index is the number of half-waves along the axis.

The invention is related to improve the heating evenness in homogeneous or spread-out low-permittivity and high penetration depth loads, so that a single, controlled so-called whispering gallery mode dominates in the space of a tank cavity. It has turned out that it is possible to design stable, huge (in terms of their volume expressed in cubed free-space wavelengths ($\lambda_0^3$)) and hitherto unknown single-mode applicators.

This class of microwave cavities used herein are characterised by being cylindrical (in the mathematics sense, i.e. having a constant cross section), with a reasonably smooth periphery curvature. A circular cross section is normally preferred, in particular for pressurised systems.

Modes that can exist in circular waveguides and have a large m index and a low n index (1 or maximum 2) are in the literature often called whispering gallery modes. The expression emanates from similar acoustical modes first being discovered in circular galleries in large buildings, according to historical evidence in St Paul's cathedral in London. They are characterised by most of the propagating energy being confined to a comparatively thin region along the periphery, with the axis region being essentially fieldless.

Whispering gallery modes have n=1 (or possibly 2, although such modes are deprecated here). The preferred p index may be the lowest possible, i.e. 1 in most applications, but higher p values may be preferred in systems with the lowest feasible m indices, since desired internal load resonances are typically enhanced by a low m index and a the cavity diameter increases significantly with increased p index for such cavities, so that a larger diameter load can be used without the load being too close to the cavity feed.

Such TE modes have an axial H field (which is basically the only H field component in the applicator when the index p is low) with a maximum in the axial direction at the feed location and other zeroes at the end walls or the locations where other means (according to other embodiments) are used to axially confine the mode. When higher p indices are used, a typical result is power density minima in load zones in the axial direction, resulting from the lack of radial inwards-going excitation in the regions of these minima. However, such minima may disappear when the load is internally resonant, which may occur in low-loss loads with reasonably small diameter. The power density minima are of no importance if the load is transported axially trough an open-ended cavity, which may be possible in cavities with low m index.

According to the present invention, the particular modes are employed for: 1) confining and controlling the field pattern to a large applicator periphery, and 2) allowing the mode to "leak" radially inwards, so that its field energy is made available for dissipation over a large area load surface, in spite of the mode being fed from a very small, single antenna at the periphery.

A very important aspect of this use of these particular modes is that the resonant frequency of the empty cavity (or applicator) is very similar to that of a loaded one, since the radial inwards-going fields are inductive, and thick dielectric loads as are used here are also inductive, but weakly. Therefore, the loading does not influence the system resonance frequency significantly. This is a major advantage with the present invention, since different loads can be used with the same, standardised applicator without any need for dimensional changes of it.

The choice of index m for optimised function according to the invention is intricate. The limitations and preferences are:

1. Modes with second (n) index >1 result in modes with a lower m index possibly becoming resonant. If the resonant frequency of such a mode is close to a desired mode with n=1, mode interference will in general result in an uneven heating pattern. Therefore, n=1 modes having adjacent n>1 modes are to be avoided.
2. The radial inwards-going mode field is evanescent, and this evanescence is of course stronger for smaller diameters of the cavity. A further limitation for low m is that the load diameter must then be small, resulting in a possibility for unwanted internal load resonance phenomena, and also a weakened coupling (a high quality factor (Q) of the resonance). However, such phenomena can also be used constructively, for certain load diameters and permittivities. Hence, cavities with a low m index and a p index >1 (in some cases up to 5 or more) may also be useful.
3. For very large m indices, either the voluminous elongated load distance from the cavity periphery can be large, which results in an increased likelihood for other unwanted modes being excited—or be small, in which event the radial evanescence becomes so insignificant that unwanted dielectric surface waves occur on the load. In any of these cases, there is a limitation upwards on m.
4. Multiple microwave feeds are desirable in large systems, in order to avoid too high power flow through each feed structure which may cause overheating and an increased risk for arcing, particularly if a used dielectric antenna becomes contaminated It is then typically desirable to locate these feeds at a distance from each other in a cross-sectional plane of the cavity of 180° (two diametrical rows) or 120° (three rows). For this to be feasible and to provide possibilities for simple arrangements for reducing the inter-feed so-called crosstalk, the m index preferably must then be divisible by 2 and 3, respectively.

Item 1 in the above listing can be quantified by using comprehensive tables of Bessel function derivative zeroes, which exist in the microwave engineering literature. It is then concluded that m around 9 . . . 11 and 20 . . . 23 should be avoided, in consideration of item 1.

Lower m than 8 and 6 are not feasible with low p indices, in consideration of items 1 and 2.

The lowest reasonable and feasible m index is 4, but the p index must then be much higher than 1, for example 5, 6 or 7.

A high but feasible m, also in consideration of items 3 and 4, is m=30, under conditions of division of the energised zones in the circumferential direction. This may be the highest practically useful m index, and results in a tank cylinder diameter of about 1280 mm at 2450 MHz. Other favourable m values are 24, 18, 16, 15, 14, 12 and 8.

The resonant frequency $f_R$ of a cavity with the $TE_{m;n;p}$ mode is calculated by the following known equation:

$$f_R = \frac{c_0}{2\pi a}\sqrt{x'^2_{mn} + \left(\frac{p\pi a}{h}\right)^2} \qquad \text{(EQUATION 1)}$$

where $c_0$ is the speed of light, a the cavity radius, h its height, mnp the mode indices and $x'_{mn}$ the n:th zero of the Bessel function derivative $J'_m(k_\rho\alpha)=0$. As an example for m=18 (which corresponds to $x'_{m,1}=20.144$), the correction for a cavity having a diameter of 785 mm and a length of 1000 mm for p=1 becomes about 4 MHz (the resonant frequency becomes 2453 MHz for p=1, compared to the "axial cut-off" frequency 2449 MHz, corresponding to p=0). As another example, the cavity diameter for 2450 MHz resonance of the $TE_{m;1;1}$ mode in a 610 mm long cavity is about 208 mm, but if p=7 is used, the 610 mm long cavity gets 315 mm diameter for 2450 MHz resonance. This larger diameter allows a 100 mm or more diameter load to be used, and will typically create internal resonant phenomena in it, while the direct coupling to it from the antenna is very low.

Anyone skilled in the art will now realise that it is possible to construct an elongated cavity with constant diameter and with subsequent, separately energised axial zones having different m indices. This is achieved by having a high p index in combination with a low m index in one part, and a lower p index in combination with a higher m index in the other part. The fine-tuning of the systems for equal resonant frequency is by changes of their lengths. There is also a need for reducing the microwave coupling between the sections in the axial direction. This is dealt with later. A combined system of this kind may provide an improved heating evenness of loads, which are transported axially through the cavity, since the field patterns are different and complement each other. This kind of systems are most useful with a lowest m index of 4 to 6, with load diameters of about $\lambda_0$ or less.

If the p index is small, only a small adjustment of the values obtained from the Bessel function zero tables is needed to compensate for it. The correction also depends on the axial dimensions of the system. Typical cylindrical cavity diameters for selected m indices then become those given in Table 1.

TABLE 1

| m index | Resonant diameter in mm of cavities at 2450 MHz, with small p index |
|---|---|
| 6 | 295 |
| 8 | 380 |
| 12 | 540 |
| 14 | 630 |
| 15 | 670 |
| 18 | 790 |
| 24 | 1040 |
| 30 | 1270 |

The proper radial distance from the cavity wall to the load has also been studied. A distance down to 80 mm (at 2450 MHz) may work for the smaller indices, and about 150 mm is needed for the largest indices, if there are no additional mode-guiding means (this will be further discussed below; they are, however, already included in FIGS. 1 and 2); these means are in order not to disturb the whispering gallery mode pattern. The proper minimum distances also depend on the geometric pattern of individual load items, and their permittivity. Examples will be given later.

It is to be noted that the diameters in Table 1 are to be multiplied by 2450/915=2,68 for 915 MHz systems. Also the wall-load distances are to be multiplied with the same figure.—As examples for 915 MHz, for the favourable m=18 mode the tank cavity diameter becomes 2120 mm, and for the m=30 mode, the tank cavity diameter becomes 3400 mm. For other operating frequencies used in some countries, such as 896 and 918 MHz, corresponding quotients are used.

A preferred embodiment of the present invention will know be described in detail with references to the figures.

FIG. 1 shows a simplified illustration of a microwave heating system comprising an elongated cylindrical metal cavity 2 intended for heating a voluminous elongated load (not shown in FIG. 1). The system comprises microwave feeding means 4 arranged to generate a single mode of the circular type $TE_{m;n;p}$ inside the cavity in order to heat the elongated load, wherein the circumferential index m is at least 6, the radial index n=1 and the axial index p being equal to or less than 3.

The circumferential index m preferably is divisible by 2 or by 3 and preferred numbers for m is 6, 8, 12, 14, 15, 18, 24 or 30; see Table 1.

Also shown in the figures are mode-guiding means 8 in the form of metal plates arranged in a radial direction with regard to the elongated cavity, galvanically fixed to the inner surface along said cavity and running along the main axis of said cavity. The mode-guiding means will be further described below.

Figure 2:
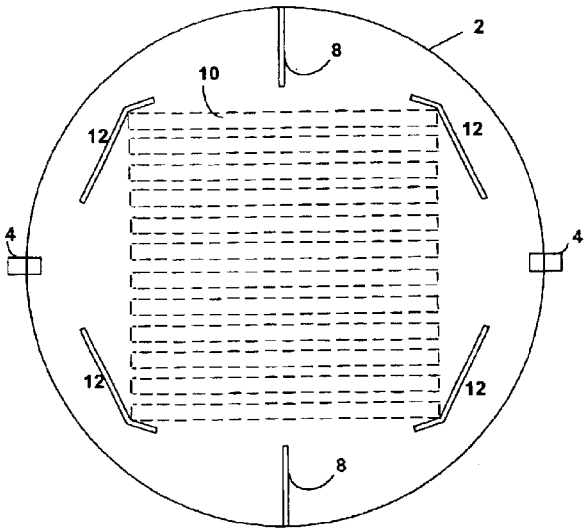
FIG. 2 shows a cross-sectional view of the cavity according to a first preferred embodiment of the present invention.
Figure 5:
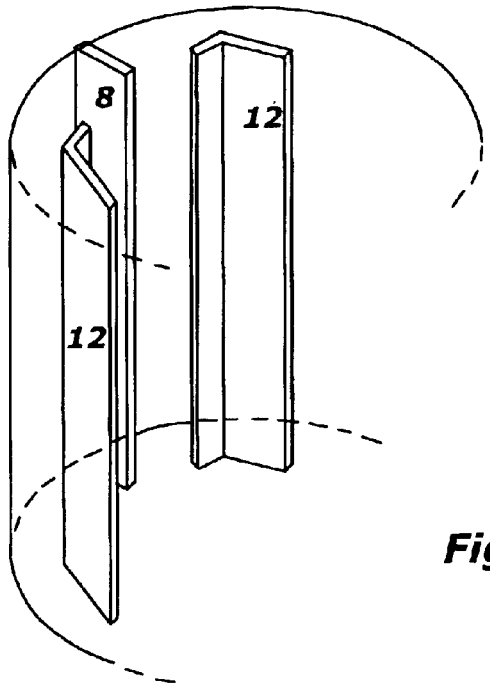
FIG. 5 shows a simplified partial view of the cavity according to a first preferred embodiment of the present invention.

In a further embodiment of the present invention wave guiding plates 12 are arranged for increasing the load filling factor. The plates run in the axial direction of the cavity. Preferably four metal plates are arranged as illustrated in FIG. 2. Two of the metal plates 12 are also seen in FIG. 5.

In FIG. 1 is also illustrated mode-confining means 14 in the form of one array of inwards radially directed, symmetrically located metal posts arranged at the inner surface of the elongated cavity and in the same cross-sectional plane of the cavity, wherein each array comprises 2 m pieces of metal posts. The reason for arranging these metal posts will be discussed below.

According to a preferred embodiment, as shown in e.g. FIG. 1, the cavity has a circular or an essentially circular cross section.

If optimal pressure withstanding properties are of primary importance, a circular cross section becomes preferable. If, however, the confinement in the cavity is focused on noxious or poisonous or flammable gases, and the load geometry is difficult or impossible to modify, elliptic cavities offer advantages.

A primary advantage with the microwave feeding located where the ellipse curvature is largest (at the end of the major axis) is then that the mode field is more strongly evanescent towards the cavity centre from there, so that the fields emanating directly from the antenna towards the voluminous elongated load are significantly reduced. The mode field is less evanescent inwards where the cavity curvature is smallest (at the minor axis), which results is an advantageous, more efficient coupling to the load in that region. Hence, a voluminous elongated load with elliptic or rectangular cross section can be heated more evenly with an elliptic cavity. Basically, this results from the added freedom of choice of a parameter (the eccentricity), to better match particular load cross-section geometry and dielectric properties.

Most of the possible features of the circular cavity design according to the invention remain, however; only modes with m divisible by 2 are of interest, since three axial/radial plates cannot be used.

Analytical calculations of the dimensions of the cavity require use of Mathieu functions. It is then much easier to use electromagnetic modelling, for example by commercially available software. As an example, very even heating of a centred long rectangular voluminous elongated load with cross section 250×150 mm and permittivity 4-j 1 can be achieved at 2460 MHz in a single-fed (at the end of the major axis) cavity with major axis 800 mm, minor axis 400 mm and length (or section length, see below) of 500 mm, but having no other metal objects/plates. The mode has then the circumferential index m=14.

Thus, when using elliptical cross section of the cavity the two feeds in the same elliptical plane are arranged at the ends of the major axis and the m index is even and two opposite metal plates are arranged at the minor axis locations.

Less advantageous, but still possible and within the scope of the claims, is to have a regular hexagonal cross-section of the cavity. Generally, any regular polygon with six or more sides would be a possible cross-sectional shape of the cavity.

A unique property of the whispering gallery modes used herein is that the lack of curvature in the axial direction makes it possible to maintain modes with a very low p index also in long cavities. Another reason for this being possible is the weak coupling of the cavity mode to the load, and the fact that both the radial inwards-going field and the load are inductive, so that the resonant frequency bandwidth can be quite small (±10 MHz or less, for systems so designed, with a comparatively large distance from the cavity cylindrical wall to the load) and also quite independent of the load and its permittivity. As an example in the $TE_{18;1;1}$ case at 2450 MHz, a 1000 mm long cavity (h=1000 mm) is easily achievable.

Since a very large part of the mode field energy is just at the cavity cylindrical wall, controlling it axially becomes very efficient also with quite small metal posts 14.

The choice of axial distances between the metal post planes (in cases where more than one plane is arranged) will thus be determined by the following factors:

The power flux density towards the load; a higher power per antenna, two or three in each antenna plane instead of a single one, or a shorter distance between post planes, alone or in combination, give a higher power flux density.

The stability and discrimination of the mode field pattern; a very short distance between post planes gives an unfavourably high $p\pi\alpha/h$ term for determination of the resonant frequency, see equation 1, by more disturbing modes with other m and p indices becoming too close, and will also result in an increased and less predictable crosstalk between axially adjacent antennas due to the same phenomenon and also due to direct coupling effects between the antennas—a very long distance between post planes will cause mode instability problems if the microwave properties of the load vary much during the process, exacerbated by the closer resonant frequencies for adjacent p values due to the large h value (i.e. the larger resonator volume).

In the preferred embodiments for large index m, the axial length h of the region where the studied mode exists is chosen to be within the cavity diameter 2 $\alpha$ within a factor of about 2, but is to be at least about $2\lambda_0$. An example of this is given earlier: for the TE (18;1;1) mode at 2450 MHz ($\lambda_0 \approx 122$ mm), the diameter=790 mm, and the length h=1000 mm, or 800 mm in FIG. 1. Another example is also given earlier: for the TE (4;1;7) mode at 2450 MHz; the cavity diameter is 315 mm and the length is 610 mm. As will be dealt with later, multiple feed locations in different axial positions can be used. The total cavity length L then consists of several h's which may be equal or unequal. As an example, L=2 h in FIG. 1

The feeding means 4 comprises at least one dielectric waveguide body, preferably a homogenous body, continuing radially inwards into the cavity and there forming a dielectric antenna.

The dielectric antennas may be arranged in rows (indicated by dashed lines 6 in FIG. 1) along the main axis of the cavity where each row comprises a number of antennas placed at a distance from each other. Typically, and when equal power density in different parts are desired, the distances between adjacent antenna planes are equal. It is naturally possible if another power density pattern is desired to arrange the antenna planes at any optional distance from each other. In the embodiment shown in FIG. 1 two dielectric antennas are arranged in each row.

The mode in the dielectric body is the TE normal mode, with the main E vector directed in the circumferential direction of the elongated cylindrical cavity.

The cross-section of the dielectric body is circular, and the mode is in that case a $TE_{11}$ mode, or the cross-section of the dielectric body is rectangular and the mode then is a $TE_{10}$ mode.

In the case where the dielectric body has a circular cross-section, fed in the 2450 MHz ISM band and made of aluminium oxide a preferred outer diameter is about 28 mm.

In the case where the dielectric body has a rectangular cross section, fed in the 2450 MHz ISM band and made of aluminium oxide the corresponding wavelength-determining dimension is about 25 mm.

In a preferred embodiment of the present invention, the dielectric waveguide is used, and made from e.g. aluminium oxide (alumina), with external metalisation, or mounted in and completely filling a stainless steel tube.

Another embodiment of the invention is to then use a protruding part of the rod into the tank cavity as an antenna for the microwave excitation of the tank cavity. This provides a simple, rugged, non-corroding feeding which in addition, due to the "smooth" non-metallic waveguiding antenna structure, reduces the risk of arcing. At its end towards the generator, the dielectric rod is end-fed directly from a standard rectangular $TE_{10}$ waveguide, into which it protrudes.

FIG. 2 shows a cross-sectional view of the cavity where the antennas are arranged according to a first preferred embodiment. In this embodiment two dielectric antennas 4 are arranged at microwave feeding points being at positions 0° and 180° in the cross-section plane of the elongated cavity.

Also shown in FIG. 2 (and also in FIG. 1) are the two mode-guiding means 8 in the form of metal plates arranged in a radial direction with regard to the elongated cavity and galvanically fixed to the inner surface along said cavity at the positions 90° and 270° and running along the main axis of said cavity. The mode-guiding means will be further described below.

Figure 3:
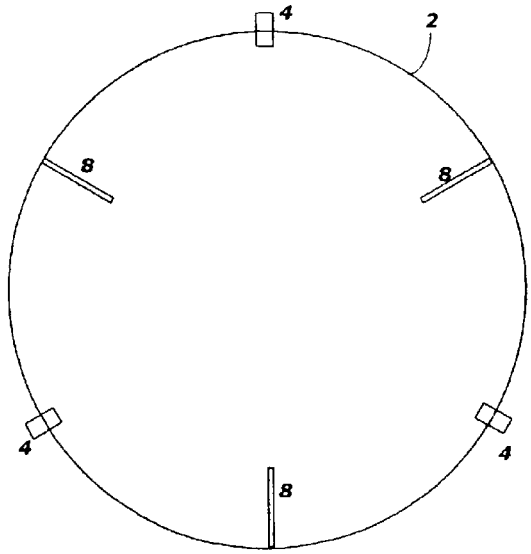
FIG. 3 shows a cross-sectional view of the cavity according to a second preferred embodiment of the present invention, without a load.

FIG. 3 shows a cross-sectional view of the cavity where the antennas 4 are arranged according to a second preferred embodiment. In this embodiment three dielectric antennas are arranged at microwave feeding points being at 0°, 120° and 240° positions in a cross-section plane of the elongated cavity.

Also shown in FIG. 3 is three mode-guiding means 8 in the form of metal plates arranged in a radial direction with regard to the elongated cavity and galvanically fixed to the inner surface along said cavity at the positions 60°, 180° and 300° and running along the main axis of said cavity.

The system is intended in a further embodiment for heating a voluminous elongated load assembly (10 in FIG. 2) with essentially square cross section, and comprises four wave guiding metal plates 12 running along the main axis of the cavity, wherein each metal plate has a flat portion and a bent portion. These wave guiding metal plates will be further discussed below.

Below follows a description of a preferred embodiment of the mode-guiding means, reference sign 8.

Quite simple means can be used to stabilise the fields with diametrical feedings (m even). An example for m=18 is shown in FIGS. 1 and 2 (in 3D and axial views). The cavity is for 2450 MHz; its total length is 2×800 mm and its diameter is 790 mm.

The microwave feeding antenna is simplified somewhat in the figure, in consideration of the large system, to a square cross section alumina block with 25 mm sides as said before, penetrating 24 mm into the cylindrical cavity.

Two diametrical plates 8 are shown in FIGS. 1 and 2. These are about 100 mm long in the radial direction and do thus not mechanically disturb the loading.

It is of interest to use the smallest possible and most easily mountable devices for axial confinement of the mode. In many cases, the large tank cavity is located and used with a horizontal axis. Where there are liquids or condensation in the cavity tank process, it is not suitable to mount antennas at the bottom. Hence, the preferred way is to mount antennas in horizontal positions as seen along the tank axis, and to then mount the circumferentially mode-limiting radial plates 8 in vertical positions. Since these plates do not need to be completely seam-welded to the tank but can instead have joints with only less than a quarter free-space wavelength apart (i.e. about 30 mm at 2450 MHz; 80 mm at 915 MHz), there will be no problems with flushing or cleaning.

Figure 4:
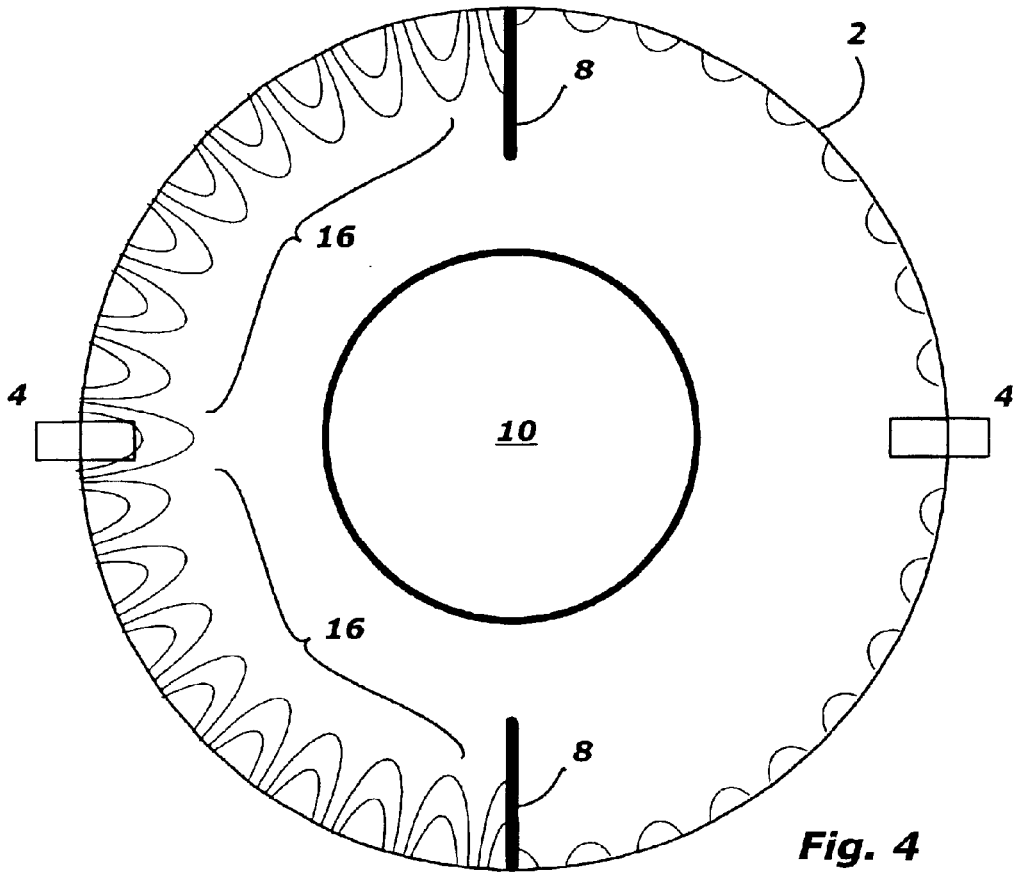
FIG. 4 shows a cross-sectional view of the cavity according to a first preferred embodiment of the present invention schematically illustrating the electric field lines in the cross section plane.

FIG. 4 is a cross-sectional view of the cavity according to the first preferred embodiment of the present invention. In this figure the voluminous elongated load 10 has a circular cross-sectional shape. The figure shows the axially directed H field 16 in the central cross section plane (i.e. the plane containing the antennas) as obtained by microwave modelling. The mode resonates only over half the cavity periphery, and is thus very effectively confined by the radial plates.

It is clearly seen that the mode is $TE_{18;1;p}$ mode, since there are 18 "field peaks" in FIG. 4. There is virtually no axial E field, as it should be by definition for TE modes. Additionally, there is almost only an axial H field, since the p index is low. Only the left antenna is energised in FIG. 4. The radial/axial plates efficiently reduce the cavity mode field strength in the opposite half of the cavity, and thus provide a very efficient limitation of the crosstalk between opposite antennas. The fields in the load are also determined by internal and external load resonance phenomena, as well as by internal trapped surface waves if the load consists of multiple items in a suitable pattern, for example as in FIG. 2.

In spite of the antenna isolation addressed above, a very significant load heating is identified also in the zone to the right of the level of the radial plates 8. The utilisation of surface wave effects to accomplish this is a further advantage of the present invention. Surface waves of the kind intentionally employed here are of the so-called trapped longitudinal section magnetic (LSM) kind. The modes are trapped between adjacent major flat surfaces of the individual load items, which are in this case in FIG. 2 long parallel wood planks. A major characteristic of such modes is their lack of H field directed perpendicularly to the major load item surfaces. Another major characteristic is that the so-called absorption distance $d_a$ becomes much longer than the penetration depth $d_p$ of the load substance as such. Furthermore, these wave characteristics depend strongly on the load item permittivity and the inter-item distance. The theory and practice of such modes is quite intricate but is known, an example with qualitative and quantitative data for microwave heating being presented in the scientific paper in the Journal of Microwave Power and Electromagnetic Energy (JMPEE), 1994, Vol 29 No 3, pp 161–170, "Confined modes between a lossy slab load and a metal plane as determined by a waveguide trough model", by Risman, P. O.

Generally, at 2450 MHz, a small distance such as 10 mm between adjacent load items gives a quite short $d_a$, whereas a distance approaching $\lambda_0/2$ will give unpredictable results and also may reduce the filling factor too much.

It is of importance that the external field polarisation is suitable for the excitation of the LSM modes and that any direct radiation from the antennas is efficiently converted to LSM modes in the load assembly. The antenna E field should then be perpendicular to the major load assembly planes between which LSM propagation is desired; this is fulfilled by the layout in all relevant figures in this description.

As an example illustrated in FIG. 2, good results at 2450 MHz are obtained with 25 mm thick wood planks stacked closely together (thus forming continuous large surface areas) with 16 mm air distance between the "levels" and having a permittivity of 6-j0,35. The wood penetration depth $d_p$ is then 143 mm, but the absorption distance $d_a$ (where about 37% of the heating intensity still remains) exceeds 300 mm. Hence, stacking load items as described can be made to result in a good heating throughout very large load assemblies. For example, using the 790 mm diameter cavity in the example discussed here allows proper heating throughout of a stack of load items as these with an overall diameter exceeding 400 mm.

As briefly indicated above a further embodiment of the present invention provides mode-confining means 14 arranged in the form of a set of metal posts. These posts can be seen in FIG. 1. Totally 2 m posts are arranged in the same cross-sectional plane of the cavity. They have in the illustrated example a diameter of 10 mm and a length of 30 mm, and effectively confine the mode so that the crosstalk between axially adjacent microwave feeds becomes negligible.

A major reason for the need of axial mode confinement is a typical need for adapting the system for load size, tank capacity and available microwave generator wattages. Even if the principles according to the invention allow an axial tank length exceeding 20 free space wavelengths while maintaining only one stable, dominating $TE_{m;1;1}$ mode with the highest m values addressed here, such systems would require a quite high power to be fed through the (only) two microwave antennas, since there would then be a substantial load mass to be heated. Hence, a desire to limit the power flux through the individual feed antennas may limit the practical total axial tank length L, which is he sum of all h's.

Another reason for using axial mode confinement means 14 is a need to limit inter-antenna crosstalk in systems where the axial distance between antennas has been made quite short, to allow a higher overall microwave power density in the load. If circulators are used on all generators, the very small antenna size in relation to the tank cavity surface will typically provide an insignificantly low crosstalk power, so that virtually no power is lost due to mutual antenna coupling. If circulators are not used in high power generator systems, typically less than 1% in total power flow into one antenna from all others is a limit of acceptance. Therefore, the crosstalk between adjacent antennas must be significantly lower than that—which will necessitate mode-confining measures.

As discussed with regard to the axial plates 8 for circumferential mode confinement, the axial mode confinement means should not interfere with flushing or cleaning or geometrically with the load itself.

The particular whispering gallery modes used here have a field energy concentration along the curved cavity surface. They therefore lend themselves to efficient confinement also in the axial direction, by relatively small metallic objects at the curved surface. Since the wave to be controlled is a resonant standing wave in the circumferential direction, it becomes sufficient to "stop" it in only certain locations, as shown in FIG. 1, i.e. in totally 2 m symmetrically distributed locations. The locking of the whispering gallery resonance pattern in the circumferential direction is by the antenna(s) and any radial plates, with maximum wall current at these. Hence, the metal post locations should be at the same angular positions as the antenna axis and any radial metal plate.

In the case when modes with different m indices are used in a cavity with unchanged diameter, the technique of using 2 m posts is no longer possible. Instead, more closely positioned posts or a more continuous circular ring welded to the cavity wall may be used.

The axial distance between the vertical plane through the antenna positions and the metal posts positions and the end walls (see below) of the cavity are equal in the lowest-order case using metal posts, shown in FIG. 1, and has two antenna planes. The axial length between the post plane and the end wall is then that (h) over which the axial index applies. For example, if p=1 there is half a guide wavelength between these planes. When there are multiple post planes, these normally have the same distance between them as twice the distance between the antenna plane and the end wall, as is the case in FIG. 1.

It is of vital importance to provide the largest possible filling factor, defined as the relation between the load volume and the volume of the cavity. The particular modes according to the invention lend themselves excellently to provide a very large filling factor compared to other cavity modes, since the determining field patterns is concentrated in a relatively narrow zone only at the cavity periphery.

In some applications, the load cross-section geometry can be circular, which may provide the largest possible filling factor. There is then only one region of concern with regard to undesirable heating: that in the vicinity of the feed antenna. It has turned out that straight shielding by a flat or curved metal plate parallel to the cavity wall and located some distance radially inwards to the cavity axis is normally not feasible, since mode impurities are then difficult to avoid. Therefore, as an example for the $TE_{18;1;1}$ mode, a distance of about $1,3\cdot\lambda_0$ from the cavity wall at the feed antenna to the most adjacent part of the load typically becomes necessary. This distance is smaller for lower m order modes. For a circular cross section load, the filling factor F then becomes 36% (using the expression $[(790-2,6\cdot\lambda_0)/790]^2$), provided there is no particular load item dispersion in order to provide an increased wave energy penetration into the central parts of the load assembly. This is very high in comparison with for example common multimode cavities, where F typically does not exceed 15%.

In other applications, the load consists of a number of individual items such as wood planks, with rectangular cross section geometry. From geometrical considerations, an overall square cross section then normally gives the maximum F. Locating the load square as in FIG. 2 then gives two advantages:

A comparatively larger distance between the load and the feed antenna is obtained, A larger distance from the load to the 90° dividing plate is obtained; alternatively this can be extended radially to provide even better reduction of the cross-talk.

There is, however, a need for the square "corners" to extend out as far as possible towards the cavity wall. Introducing the axially long wave guiding plates 12 as shown in FIGS. 2 and 5 can reduce this distance very significantly. This plate does not disturb the overall heating evenness, and shields the load corners from microwave over-exposure at these, caused by the proximity to the very strong whispering gallery mode fields. The length (in the circular cross section of the system) of the plate needs to be determined so that no external resonance phenomena can be excited around it and disturb the guiding and shielding functions. Typically, it needs to consist of a bent plate as in FIGS. 2 and 5.

The plate ends should preferably be located slightly past H field maxima, where the circumferential currents induced in it are low. It is, by this technique, possible to reduce the distance between the plate and the cavity periphery to less than $\frac{1}{2}\square_0$ (it is only 50 mm in the 2450 MHz cavity Ø790 mm in FIG. 2). The resulting filling factor F may exceed 40%.

An application area of interest with the present invention is, among others, processing of lignocellulosic materials such as wood in solid or subdivided form. The processing includes for example chemical modifications at elevated temperatures such as acetylation or other means of forming derivatives, polymerisation and treatment with aqueous solutions, steam/water or impregnating oil. Another example is reducing moisture content such as drying under controlled conditions with respect to pressure and temperature.

Primary areas of processing conditions of the invention is for microwave treatment of loads which may either need to be processed under conditions of over- or under pressure, or may need confinement since noxious, poisonous or flammable gases may be present. Hence, batch processing rather than continuous processing is then applied.

There is a need for access to the cavity, for load insertion/removal. This is achieved through doors in one or both cavity ends. The radial metal plates 8 may then additionally serve as rails for load in/out transport or as supports for the load or its additional support structure.

There is typically a need to limit the microwave currents going from the cylindrical cavity wall to the cavity door, in particular when the door(s) are primarily designed with pressure seals. This can easily be achieved by using an additional plane of metal posts in the cavity, close to the door seal region. Since currents are induced in the posts, they should be $\frac{1}{4}\lambda_0$ or more away from the door seal region. By this feature, low leakage at the door seals can be achieved without a need for particular and efficient capacitive or wavetrap microwave seals in the door or its cavity mating area. Conductive door seals are deprecated, since they may deteriorate with wear and corrosion. Instead, microwave-absorbing ferrite strips may be used on the outside in the mating region, to reduce the microwave leakage to ambient.

The invention further comprises a method of heating a load, by a microwave heating system as described in the present application, whereas the load comprises multiple elongated load items positioned in rows with a small or no distance between adjacent load items and a distance of between $\lambda_0/12$ and $\lambda_0/3$ between adjacent rows so that longitudinal section magnetic (LSM) modes can exist between rows, where $\lambda_0$ is the free space wavelength.

The individual load items preferably have an essentially rectangular cross section and that the load row spacings are positioned in the radial direction towards the dielectric antenna(s).

The load alternatively consists of a single elongated item with an essentially circular or square cross section and in that case using an index m of 12 or less. The load cross section dimensions are chosen in relation to its permittivity so as to obtain internal resonance in the load.

The present invention is not limited to the above-described preferred embodiments. Various alternatives, modifications and equivalents may be used. Therefore, the above embodiments should not be taken as limiting the scope of the invention, which is defined by the appending claims.

What is claimed is:

1. Microwave heating system comprising an elongated cylindrical metal cavity intended for heating an elongated load, wherein said system comprises microwave feeding means arranged to generate a single mode of the circular type $TE_{m;n;p}$ inside said cavity in order to heat the elongated load, wherein the circumferential integer index m is at least 4, the radial index n=1 and the axial index p being an integer >0: and wherein said feeding means comprises at least one dielectric waveguide body continuing radially inwards into the cavity and there forming a dielectric antenna.

2. Microwave heating system according to claim 1, wherein said elongated load is essentially centred in said cavity.

3. Microwave heating system according to claim 1, wherein said cavity has an essentially circular cross section.

4. Microwave heating system according to claim 1, wherein the index m is divisible by 2.

5. Microwave heating system according to claim 1, wherein the index m is divisible by 3.

6. Microwave heating system according to claim 1, wherein the index mis 6, 8, 12, 14, 15, 18, 24 or 30.

7. Microwave heating system according to claim 1, wherein the index m is 4, 6 or 8 and the index p is greater than 3.

8. Microwave heating system according to claim 1, wherein dielectric antennas are arranged in one or many rows along the main axis of the cavity where each row comprises a number of antennas placed at equal distance from each other.

9. Microwave heating system according to claim 8, wherein pairs of dielectric antennas are arranged at microwave feeding points being at positions 0° and 180° in cross-section planes of the elongated cavity.

10. Microwave heating system according to claim 8, wherein three dielectric antennas are arranged at microwave feeding points being at 0°, 120° and 240° positions in a cross-section plane of the elongated cavity.

11. Microwave heating system according to claim 1, wherein pairs of dielectric antennas are arranged at microwave feeding points being at positions 0° and 180° in cross-section planes of the elongated cavity.

12. Microwave heating system according to claim 11, wherein two mode-guiding means in the form of metal plates are arranged in a radial direction with regard to the elongated cavity and galvanically fixed to the inner surface along said cavity at the positions 90° and 270° and running along the main axis of said cavity.

13. Microwave heating system according to claim 1, wherein three dielectric antennas are arranged at microwave feeding points being at 0°, 120° and 240° positions in a cross-section plane of the elongated cavity.

14. Microwave heating system according to claim 13, wherein three mode-guiding means in the form of metal plates are arranged in a radial direction with regard to the elongated cavity and galvanically fixed to the inner surface along said cavity at the positions 60°, 180° and 300° and running along the main axis of said cavity.

15. Microwave heating system according to claim 1, wherein the mode in the dielectric body being the TE normal mode, with the main E vector directed in the circumferential direction of the elongated cylindrical cavity.

16. Microwave heating system according to claim 1, wherein the cross-section of the dielectric body is circular, and the mode being a $TE_{11}$ mode.

17. Microwave heating system according to claim 16, wherein the dielectric body is fed in the 2450 MHz ISM band and made of aluminium oxide and has circular cross section with an outer diameter of about 28 mm, or is fed in the 915 MHz band and has an outer diameter of about 75 mm.

18. Microwave heating system according to claim 1, wherein the cross-section of the dielectric body is rectangular and the mode being a $TE_{10}$ mode.

19. Microwave heating system according to claim 18, wherein the dielectric body is fed in the 2450 MHz ISM band and made of aluminium oxide and has a rectangular cross section with the wavelength-determining dimension of about 25 mm, or is fed in the 915 MHz band and has a corresponding dimension of about 67 mm.

20. Microwave heating system according to claim 1, wherein the dielectric body being made of aluminium oxide.

21. Microwave heating system according to claim 1, wherein one or several arrays of inwards radially directed, symmetrically located mode-confining metal posts are arranged at the inner surface of the elongated cavity and in the same cross-sectional plane of the cavity, wherein each array comprises 2 m pieces of metal posts.

22. Microwave heating system according to claim 1, wherein said system is intended for heating an elongated load assembly with essentially square cross section, and comprises four guiding metal plates running along the main axis of the cavity, wherein each metal plate has a flat portion and a bent portion.

23. Microwave heating system according to claim 1, wherein said system is adapted-for heating wood items.

24. Microwave heating system according to claim 1, wherein said cavity comprises access doors in one or both cavity ends, for load insertion and removal.

25. Method of heating a load, wherein the heating is performed by a microwave heating system according to claim 1, whereas the load comprises multiple elongated load items positioned in rows with a small or no distance between adjacent load items and a distance of between $\lambda_0/12$ and $\lambda_0/3$ between adjacent rows so that longitudinal section magnetic (LSM) modes can exist between rows, where $\lambda_0$ is the free space wavelength.

26. Method of heating a load according to claim 25, wherein said load item has an essentially rectangular cross section.

27. Method of heating a load according to claim 26, wherein the load row spacings are positioned in the radial direction towards the dielectric antenna(s).

28. Method of heating a load according to claim 27, wherein said load alternatively consists of a single elongated item with essentially circular or square cross section.

29. Method of heating a load according to claim 28, wherein by using an index m of 12 or less and choosing the load cross section dimensions in relation to its permittivity so as to obtain internal resonance in the load.

30. Microwave heating system comprising an elongated cylindrical metal cavity intended for heating an elongated load, wherein said system comprises a microwave feeding device that generates a single mode of the circular type $TE_{m;n;p}$ inside said cavity to heat the elongated load;

wherein the circumferential integer index m is at least 4, the radial index n=1 and the axial index p being an integer >0; and wherein said feeding device comprises at least one dielectric waveguide body continuing radially inwards into the cavity and there forming a dielectric antenna.

* * * * *